United States Patent [19]

Schoenleber et al.

[11] Patent Number: 4,801,076

[45] Date of Patent: Jan. 31, 1989

[54] ADVERTISING POUCH ASSEMBLY FOR DISTRIBUTING ADVERTISING LITERATURE OR THE LIKE

[75] Inventors: Donald Schoenleber, Princeton; Frederick Grainger, West Greenbrook; Patrick J. Donahue, Hamilton Square, all of N.J.

[73] Assignee: Webcraft Technologies, Inc., No. Brunswick, N.J.

[21] Appl. No.: 918,892

[22] Filed: Oct. 15, 1986

[51] Int. Cl.[4] ..... B65D 27/14

[52] U.S. Cl. ..... 229/92.7; 229/92.8

[58] Field of Search ..... 229/92.8, 92.7

[56] References Cited

U.S. PATENT DOCUMENTS

| | | | |
|---|---|---|---|
| 311,915 | 2/1885 | Pedrick | 229/92.7 |
| 686,261 | 11/1901 | Collins | 229/92.7 |
| 846,988 | 3/1907 | Farmer | 229/92.7 |
| 868,273 | 10/1907 | Johnson | 229/92.7 |
| 954,336 | 4/1910 | Patton . | |
| 958,166 | 5/1910 | Patton . | |
| 975,737 | 11/1910 | Utley | 229/92.7 |
| 989,614 | 4/1911 | Laake | 229/92.7 |
| 1,886,669 | 11/1932 | Gillespie | 229/92.8 |
| 1,965,389 | 7/1934 | Parr | 229/92.7 |
| 2,270,455 | 1/1942 | Lichter . | |
| 2,298,601 | 10/1942 | Tremblett | 229/92.7 |
| 2,522,256 | 9/1950 | Croft | 229/92.8 |
| 3,194,482 | 7/1965 | Berkley . | |
| 3,713,673 | 1/1973 | Katz . | |
| 3,833,167 | 9/1974 | Kapiton | 229/69 |
| 3,941,309 | 3/1976 | Gendron . | |
| 4,011,985 | 3/1977 | Simson . | |
| 4,033,611 | 7/1977 | Johnsen . | |
| 4,204,600 | 5/1980 | Pritchard . | |
| 4,487,360 | 12/1984 | Fisher . | |
| 4,595,138 | 6/1986 | Kristel . | |

*Primary Examiner*—Stephen P. Garbe

*Attorney, Agent, or Firm*—Shlesinger Arkwright & Garvey

[57] ABSTRACT

The present invention pertains to an advertising pouch assembly for distributing advertising literature and the like to consumers through the mail or other appropriate means. The advertising pouch assembly is comprised of a first web and a second web. The second web is superimposed on the first web to form an inner pocket. In one embodiment of the advertising pouch assembly, the first web includes a closure flap, a backing panel, an advertising panel, a first business reply card panel, and a second business reply card panel. The second business reply card panel is folded along a hinge line and is secured to the first business reply card panel thus forming two business reply cards. The second web consists solely of a cover panel. The cover panel is secured to the backing panel in such a manner as to form a pocket whose opening is adjacent the closure flap. A portion of the cover panel is free from the backing panel to permit multiple sheets of literature to be inserted in the pocket by mechanical means.

18 Claims, 4 Drawing Sheets

ADVERTISING POUCH ASSEMBLY FOR DISTRIBUTING ADVERTISING LITERATURE OR THE LIKE

FIELD OF THE INVENTION

This invention pertains to an advertising pouch assembly for distributing advertising literature or the like to consumers through the mail or other appropriate means.

BACKGROUND OF THE INVENTION

This invention relates to the use of advertising circulars for disseminating advertising literature or the like to consumers.

Numerous devices have been used to distribute literature to consumers. U.S. Pat. Nos. 954,336 to Patton; 958,166 to Patton; 1,114,920 to Seeligson; 2,270,455 to Lichter; 2,759,658 to Sawdon; 3,194,482 to Berkley; 3,713,673 to Katz; 3,941,309 to Gendron; 4,011,985 to Simson; 4,204,600 to Pritchard; are indicative of the devices more commonly employed.

Seeligson in U.S. Pat. No. 1,114,920 discloses an advertising insert for books and the like. The insert is formed from a single sheet. A first section of the advertising insert is provided with advertising information. A business reply card envelope is formed on the second section of the insert.

Patton in U.S. Pat. Nos. 958,166 and 954,336 discloses similar advertising brochures. Each brochure is comprised of a single sheet. A plurality of spaced weakness lines are formed in the sheet defining a number of panels. The end panel is folded along a weakness line to lie flat on the panel directly adjacent it. In this manner, an envelope is formed. The opening of the envelope is formed inward of the advertising device.

Lichter in U.S. Pat. No. 2,270,455 discloses a mailing circular formed from a single sheet. A business reply card is formed by folding an end panel onto the panel directly adjacent it.

The advertising devices heretofore produced and generally illustrated by the above-discussed prior art do not provide adequate devices to disseminate advertising literature to consumer's either because they are not of the mailing type, cannot be machine stuffed with additional sheets of literature or do not have an inner envelope-like pouch formed from a second web piece with advertising indicia printed thereon.

SUMMARY OF THE INVENTION

Accordingly it is a feature of this invention to provide an improved mailing circular for distributing advertising literature or the like to consumers.

Another feature of the invention is to maximize the amount of space and advertising literature in a mailing circular which is distributed to consumers.

In summary, the advertising pouch assembly of the present invention is comprised of a first web piece. The second web piece is superimposed on a panel of the first web piece forming an inner envelope-like pouch for receiving multiple sheets of advertising literature. Forming the envelope-like pouch from a second web piece, as opposed to folding one panel onto a panel directly adjacent it, enables the merchant to print advertising indicia or the like for page-like readability on the top face of the envelope cover panel of the second web piece. Thus the merchant maximizes the number of panels of the advertising pouch assembly on which he can display advertising literature. The specific interrelationship of the second web and the first web so that the opening of the envelope-like pouch is directly adjacent the closure flap and adaptable to widen the access to the inner pouch permits machine stuffing of multiple sheets of literature. Additionally, the business reply cards detachably connected to the advertising panel of the first web piece provides the consumer with a convenient means to purchase items from the solicitor.

DETAILED DESCRIPTION OF THE INVENTION

FIGS. 1–4

Figure 1:
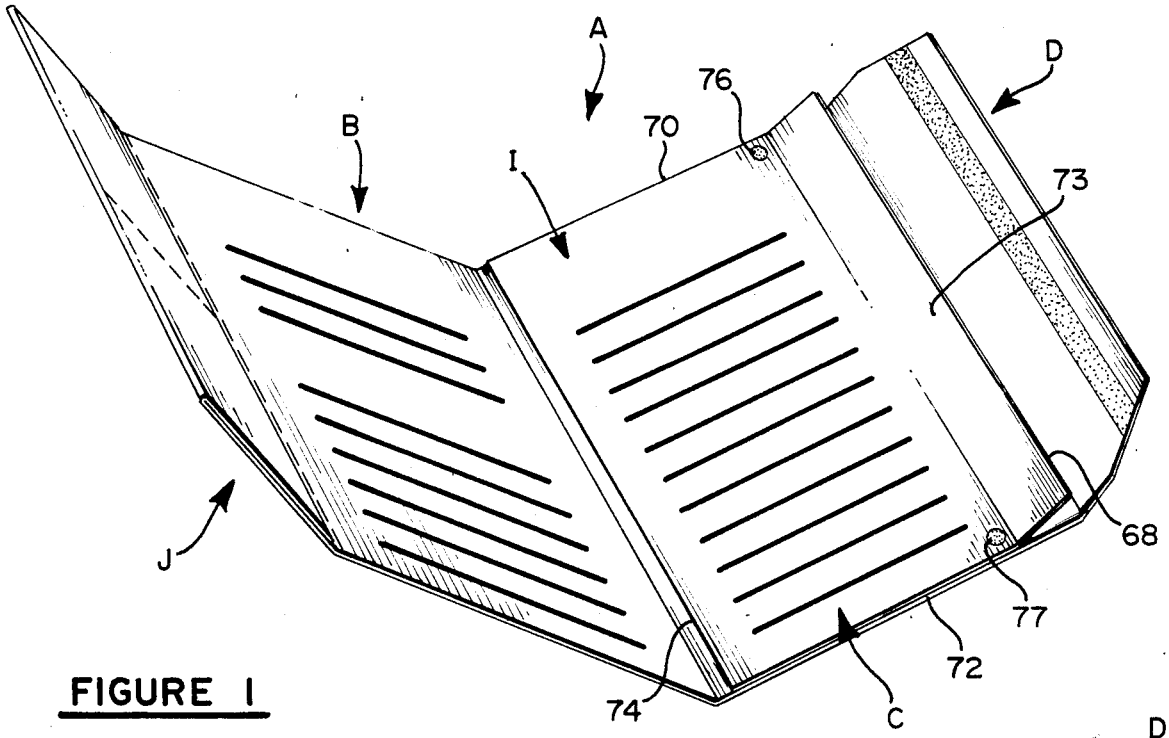
FIG. 1 is a perspective view of the top surface of an advertising pouch assembly.

Advertising pouch assembly A is comprised of first web piece B and a second web piece C. The second web piece C is superimposed on a panel of the first web piece B to form an envelope-like pouch for receiving multiple sheets of literature.

First web piece B includes closure flap D, a backing panel E, an advertising panel F, a first business reply card section panel G, and a second business reply card section panel H.

The closure flap D has a top edge 2, left and right edges 4 and 6 respectively and a bottom periphery along fold line 8. Left and right edges 4 and 6 each are angled at portions 10 and 12 respectively to provide a taper to the side edges of the flap (which is approximately 30° ) along each edge. This taper facilitates the insertion of advertising pieces into the pouch. A remoist glue adhesive strip 14 extends across the closure flap D.

Figure 3:
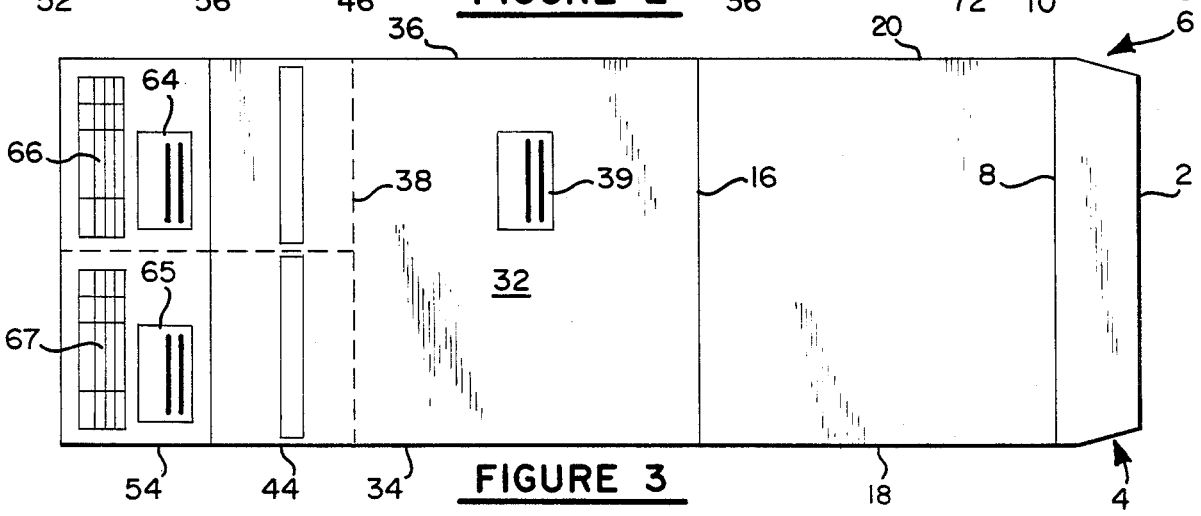
FIG. 3 is a plan view of the bottom surface of the advertising pouch assembly completely unfolded.
Figure 4:
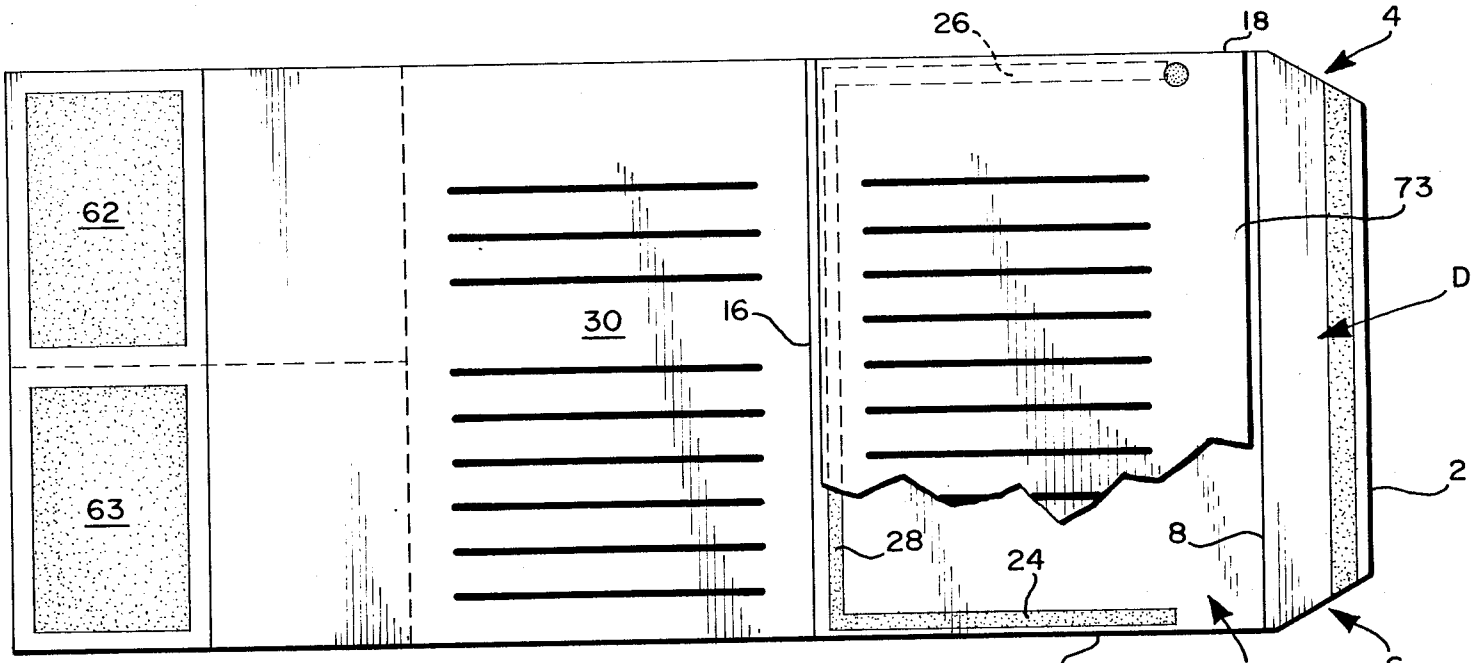
FIG. 4 is a fragmentary plan view of the top surface of the advertising pouch assembly.

As shown in FIGS. 3 and 4, the envelope pouch backing panel E extends from fold line 8 where it is hingedly connected to pouch closure flap D to fold line 16, and further includes left and right edges 18 and 20 respectively. As indicated in FIG. 4, an adhesive strip 24 is applied to the inner face of backing panel E adjacent a second corresponding adhesive strip 26 shown in dotted outline and disposed adjacent edge 18. The adhesive strips 24 and 26 extend to a point short of the fold line 8 (about 1 inch short) so as to permit opening of the envelope pouch for machine stuffing. An adhesive strip 28 is applied to the inner face of backing panel E parallel to and spaced from fold line 16 so as to provide for closing of the bottom of the envelope-like pouch.

Advertising panel F includes an inner face 30 which contains printed advertising while its outer face 32 contains both advertising and an address signature. Panel F has its upper periphery defined by fold line 16, through which it is hingedly connected to the bottom periphery of backing panel E. The advertising panel F has left and right edges 34 and 36 respectively, and extends to the perforated/fold line 38 at its bottom periphery. The printed advertising material of face 30 extends parallel to left and right edges 34 and 36, for page-like readability with respect to and beside a facing envelope panel I. The outer face 32 of advertising panel F has personalized indicia printed thereon, and includes the perspective customer's name and address box 39 and reads from edge 34 to edge 36 and runs parallel to fold lines 16 and 38.

The first business reply card panel G has an upper periphery defined by the common perforated/fold line 38 such that it is detachably connected to the bottom periphery of advertising panel F. It has two sections 40 and 42 disposed between left and right edges 44 and 46 respectively, with a bottom periphery defined by fold line 48. A perforated weakness line 49 extends midway between top and bottom edges 44 and 46 thereby dividing the first business reply card panel G into two detachably connected first portions of a business reply card.

Second business reply card panel H has a top periphery defined by fold line 48 such tat it is hingedly connected to panel G. It has two sections 50 and 52 disposed between left and right edges 54 and 56 which are joined by bottom edge 60. A perforated weakness line 59 divides panel H into portions 50 and 52 and is aligned with line 49, thereby forming two second portions of a business reply card. Adhesive blocks 62 and 63 are applied to the inner face of second business reply card panel H preferably, or if desired may alternately be applied to the inner face of panel G.

Personalized indicia is printed on each of the second portions of the outer face of the business reply card sections of panel H. A customer's address panel is printed at 64 and 65, as indicated in FIG. 3, such that the line of printing extends parallel to the top and bottom periphery. Order form boxes 66 and 67 are located below the address panel.

The second web piece generally designated as C is comprised of cover panel I that includes a top edge 68, left and right edges 70 and 72 respectively, and bottom edge 74. Printed indicia is contained on the inner face of cover panel I. The printed indicia extends parallel to left and right edges 70 and 72 and in the same direction as the printing on the inner adjacent surface of panel F.

The printed subject matter includes the individual respective customer's name which is incorporated as part of a letter of introduction from the seller. In this manner, the seller is able to establish a rapport with the customer immediately. The signatures are generated by computer controlled imaging systems which vary the names from each successively printed advertising envelope assembly. A message 73 is printed on inner envelope panel I adjacent top edge 68. The message 73 extends parallel to top edge 68 and is preferably in the form of an enticement to prompt consumers to read thoroughly the advertising material.

Figure 6:
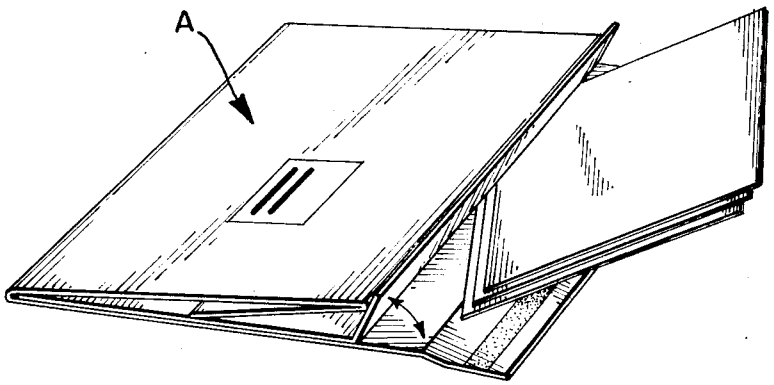
FIG. 6 illustrates the manner in which multiple sheets of literature are inserted into a pocket of the advertising pouch assembly.

As indicated in FIG. 4, the single additional envelope panel engages the glue strips 24, 26 and 28 of outer envelope panel E to form a completed envelope-like pouch. Note that the top edge of the inner envelope panel I can be moved back, as indicated in FIGS. 1 and 6, to provide a widened access to the envelope for automatic stuffing machinery. Adhesive spots 76 and 77 are applied to cover panel I adjacent left and right edges 70 and 72 as shown in FIG. 1, a distance below top edge 68. These spots serve to hold the advertising piece in a folded position when the envelope is in the process of being stuffed with advertising literature.

ASSEMBLY OF ADVERTISING POUCH

Figure 2:
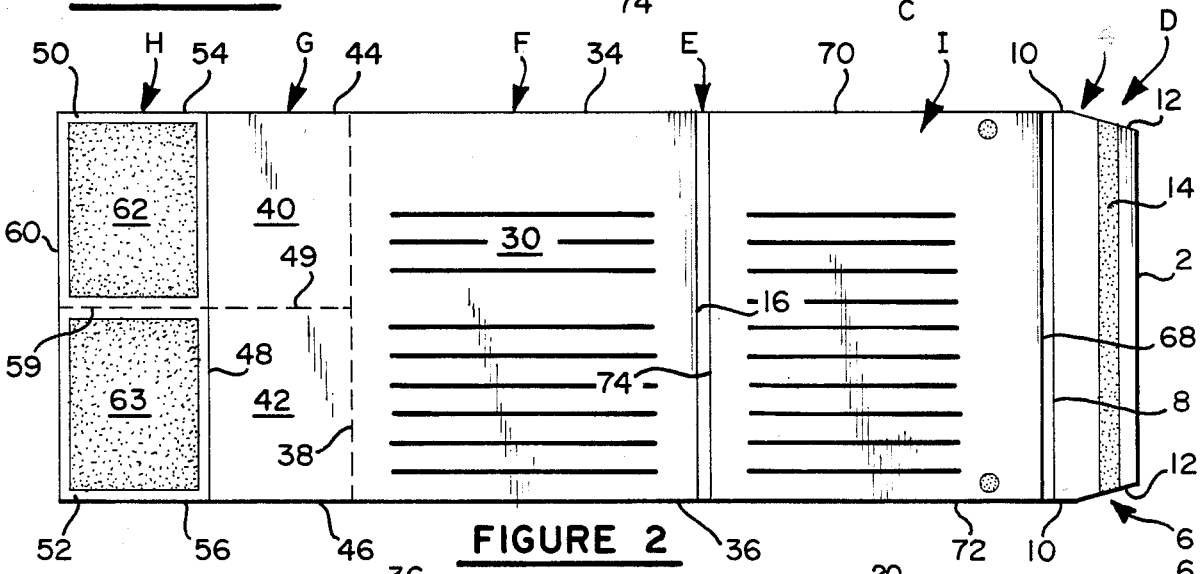
FIG. 2 is a plan view of the top surface of the advertising pouch assembly completely unfolded.
Figure 5:
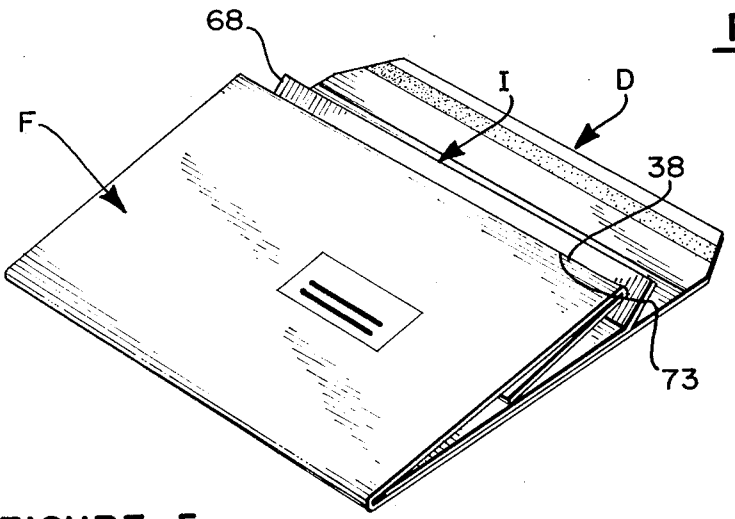
FIG. 5 is a perspective view of the advertising pouch assembly substantially folded.

FIGS. 1, 2 and 5

The particular steps taken to assemble the advertising panel will hereinafter be set forth.

Referring to FIGS. 1 and 2, second business reply card section panel H is folded along fold line 48 so that it lies flat on first business reply card section panel G. Left and right edges 54 and 56 of panel H and left and right edges 44 and 46 of panel G are all of equal length thus panel H lies directly on top of panel G. Pressure is applied to second business reply card section panel H securing it to panel G. In this manner, two business reply cards J are formed. Business reply cards J are folded along perforated/fold line 38 so that they lie flat on advertising panel F. Subsequently, advertising panel F is folded along fold line 16 so that it lies flat on cover panel I, as best seen in FIG. 5. Pressure is applied to the bottom periphery of advertising panel F to secure it to cover panel I through adhesive spots 76 and 77. Securing the advertising panel F to the cover panel I, prevents pouch assembly A from unfolding during the machine stuffing of multiple sheets of literature into the pocket.

Referring to FIG. 5, the bottom periphery of advertising panel F is inwardly offset from the top edge 68 of cover panel I. The printed message 73 formed on cover panel I adjacent top edge 68 is thus clearly visible to the prospective customer the moment the closure flap D is removed. The adhesive strip 14 is moistened and closure flap D is subsequently folded along hinge line 8 so that it lies flat on cover panel I and advertising panel F. Pressure is applied to closure flap D to secure it to advertising panel F. Closure flap D simultaneously seals the advertising pouch assembly A and the pocket. Once the closure flap D is sealed, the advertising pouch assembly A is ready to be circulated to prospective clients through the mail.

OPENING OF THE ADVERTISING POUCH

FIGS. 1, 5, and 6

The specific steps taken to open the advertising pouch A will now be described. Once the prospective client receives the advertising pouch assembly, she will remove the closure flap D from the advertising panel F. Inducement 73 printed on cover panel I will prompt the consumer to detach the advertising panel F from the cover panel I. The consumer is immediately greeted with an introduction letter from the seller conveniently printed on cover panel I. Advertising panel F enables the seller to list his line of merchandise or convey similar messages to the consumer. The pocket allows the seller to disburse additional advertising literature.

The advertising pouch assembly A provides the consumer with a convenient means for purchasing items from the seller. Business reply cards J include a first portion G and a second portion H. As previously indicated first portion G includes the appropriate address of the seller printed at 64 and 65, as seen in FIG. 3. The second portion H includes order forms 66 and 67 and the name and address of the consumer. The consumer need only fill in the order form and forward the business reply card J to the seller. An additional business reply card J is provided in case the consumer wishes to reorder.

SECOND EMBODIMENT

FIGS. 7–10

Figure 7:
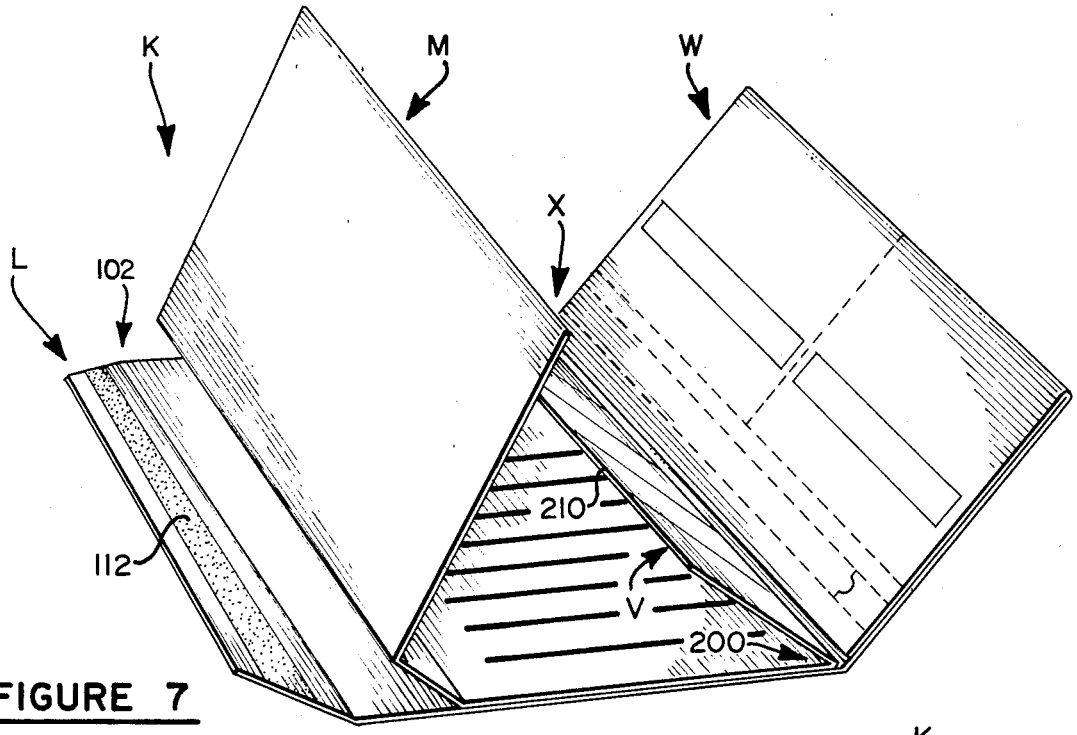
FIG. 7 is a perspective view of the second embodiment of the advertising pouch assembly partially folded.

As indicated in FIG. 7, the second embodiment includes an advertising pouch assembly K having a first web piece L, and a second web piece M. The second web piece M is superimposed on a panel of the first web piece L forming an envelope-like pocket for receiving multiple sheets of literature.

Figure 8:
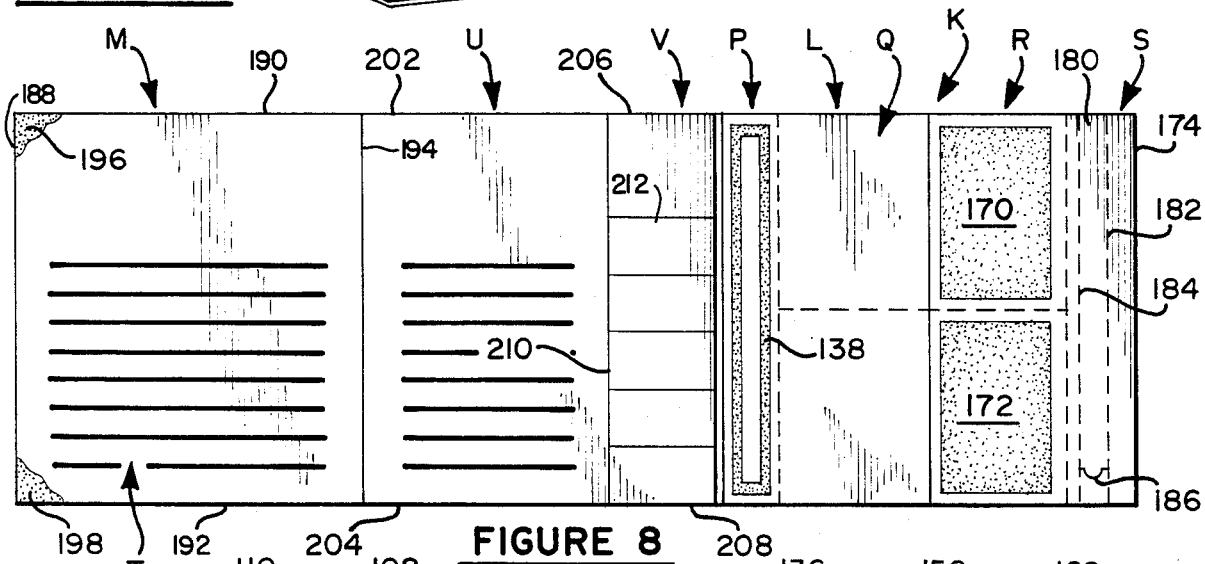
FIG. 8 is plan view of the top surface of a second embodiment of the advertising pouch assembly completely unfolded.
Figure 9:
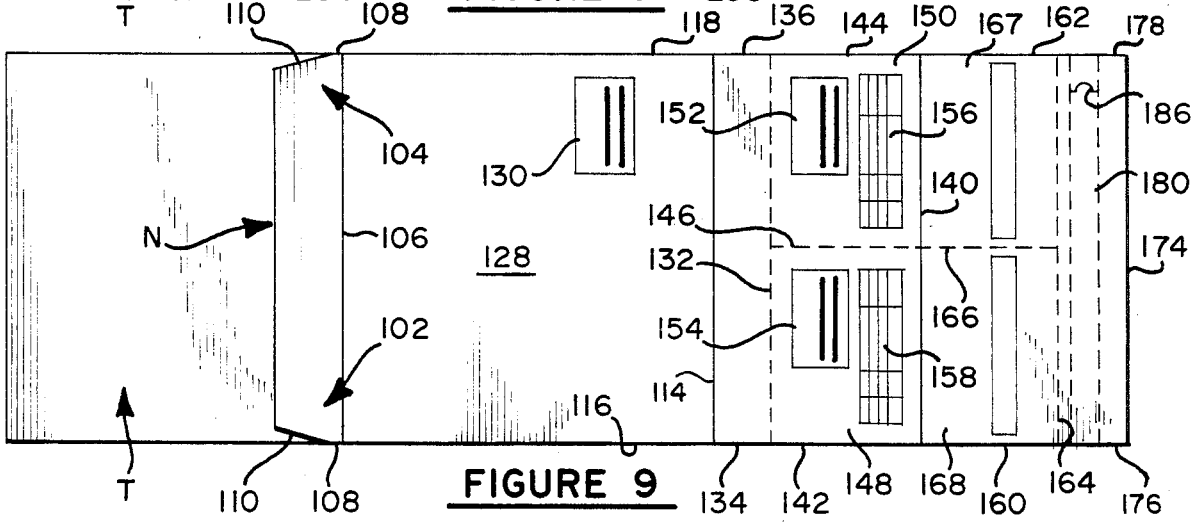
FIG. 9 is a plan view of the bottom surface of the second embodiment of the advertising pouch assembly.
Figure 10:
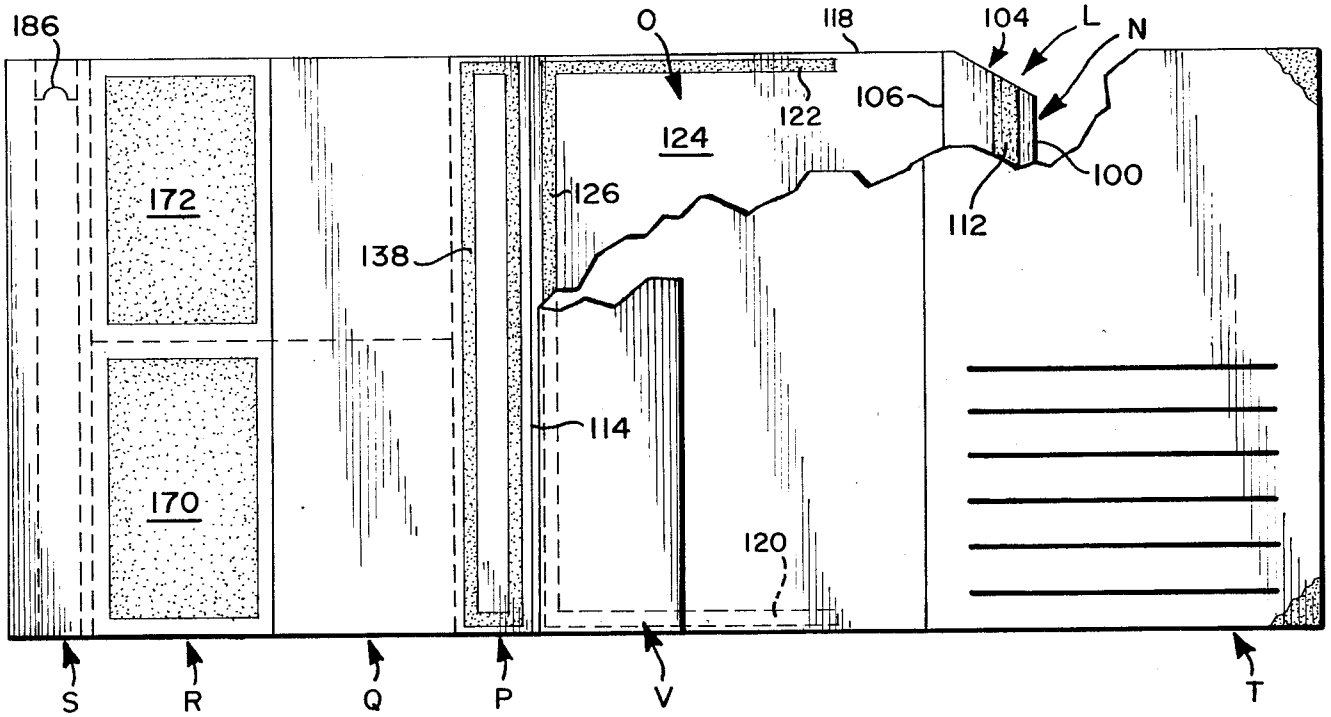
FIG. 10 is a fragmentary plan view of the top surface of the advertising pouch assembly completely unfolded.

Referring to FIG. 10, the first web piece L includes a closure flap N, an envelope backing panel 0, an intermediate panel P, a first business reply card section panel Q, a second business reply card section panel R, and an end panel S. As indicated in FIG. 9, the cover panel N includes top edge 100, left and right edges 102 and 104 respectively and a bottom periphery along fold line 106. Left and right edges 102 and 104 are each angled at first and second portions 108 and 110, as indicated in FIG. 8, to provide a tapered section along the side edges of the closure flap. Preferably, the tapered section forms an angle of approximately 30° with the side edges. A remoist adhesive 112, as best seen in FIG. 7, is applied to the closure flap N.

Backing panel 0 extends from fold line 106, where it is hingedly connected to closure flap N, to fold line 114. Envelope backing panel 0 further includes left and right edges 116 and 118 respectively. As illustrated in FIG. 10, adhesive strips 120 and 122 are applied to the inner face 124 of backing panel 0 adjacent left and right edges 116 and 118 (adhesive strip 122 is shown in dotted outline). The adhesive strips 120 and 122 only extend a portion of the length of left and right edges 116 and 118. The left and right edges each have a segment (preferably 1 inch in length) adjacent top edge 114 that is free from adhesive. An adhesive strip 126 is applied to the inner face 124 of backing panel 0 adjacent fold line 114. Referring to FIG. 9, bottom face 128 of envelope backing panel 0 has personalized indicia printed thereon including the customer's name and address box 130. The printed indicia extends parallel to fold lines 106 and 114 and reads from edge 116 to edge 118.

The intermediate panel P includes an upper periphery extending from fold line 114, where it is hingedly connected to envelope backing panel 0, to perforated/fold line 132. Intermediate panel P, additionally, includes left and right edges 134 and 136 respectively. An adhesive strip 138, as indicated in FIG. 8, is applied to the inner face of intermediate panel P adjacent fold line 114 and 132 and left and right edges 134 and 136.

First business reply card section panel Q extends from perforated/fold line 132, through which panel Q is detachably connected to intermediate panel P, to fold line 140. First business reply card section panel Q further includes left and right edges 142 and 144 respectively. A perforated/fold line 146 extends midway between perforated/fold line 132 and fold line 140, forming two detachably connected first portions of a business reply card 148 and 150. The first portions of the business reply card each have personalized indicia printed at 152 and 154 including the perspective customer's name and address box. The customer's personalized indicia extends parallel to perforated/fold line 132 and fold line 140. Order form boxes 156 and 158 are disposed below the customer's address panels 152 and 154.

Second business reply card section panel R includes an upper periphery defined by fold line 140 such that it is hingedly connected to the bottom periphery of the first business reply card section Q. Additionally, the second business reply card panel R includes left and right edges 160 and 162 respectively, and a bottom edge defined by perforated/ fold line 164. Perforated weakness line 166 extends midway between fold line 140 and fold line 164 thus forming two second portions of a business reply card 167 and 168. The second portions 167 and 168 have the return address of the seller printed thereon. Adhesive blocks 170 and 172 are preferably applied to the inner face of second business reply card panel R. Alternatively, the adhesive blocks 170 and 172 could be applied to the inner face of panel Q.

End panel S extends from perforated/fold line 164, where it is detachably connected to panel R, to bottom edge 174. Panel S further includes left and right edges 176 and 178 respectively. A tear strip 180 is formed on end panel S. Tear strip 180 includes perforated weakness lines 182 and 184 extending between left and right edges 176 and 178. A tab 186 is formed on the tear strip 180 to enable the prospective customer to remove the tear strip 180 readily.

The second web M includes an advertising panel T, a cover panel U, and an order organizer panel V. The advertising panel T includes the top edge 188, left and right edges 190 and 192, and a bottom periphery defined by fold line 194. Adhesive patches 196 and 198 are applied to the corners of the advertising panel T adjacent top edge 188. Printed indicia in the form of advertising literature is printed on the inner face of advertising panel T and extends parallel to left and right edges 190 and 192.

The cover panel U extends from fold line 194, where it is hingedly connected to advertising panel T, to fold line 200. Cover panel U further includes left and right edges 202 and 204. The inner face of cover panel U has personalized indicia formed thereon. The personalized indicia extends parallel to left and right edges 202 and 204. The personalized indicia includes the consumer's name as well as a letter of introduction from the seller. In this manner, the seller is able to immediately make personalized contact with the prospective customer.

An upper periphery of order organizing panel V is defined by fold line 200, where it is hingedly connected to cover panel U. Order organizing panel V further includes left and right edges 206 and 208 respectively, and bottom edge 210. On the outer face of panel V the consumer is provided with order record forms 212 whereon the consumer can indicate the catalogue number and description of the article he desires to purchase. In this manner, the consumer will be able to readily keep track of the orders he has placed.

As indicated in FIG. 7, the envelope cover panel U of second web M engages the adhesive strips 120, 122 and 126 of envelope backing panel 0 to form a completed envelope-like pocket. The top edge of the envelope cover panel U can readily be raised away from panel 0 providing a widened access to the envelope-like pouch for automatic stuffing machinery.

ASSEMBLY OF THE ADVERTISING POUCH OF THE SECOND EMBODIMENT

Figure 11:
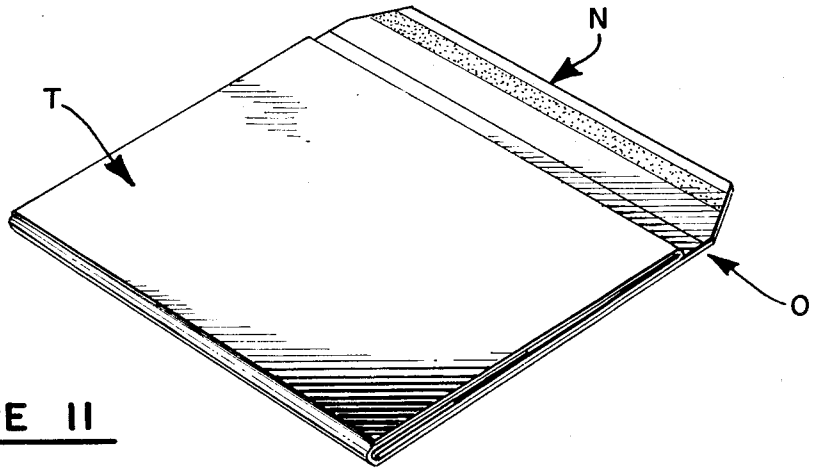
FIG. 11 is a perspective view of the second embodiment of the advertising pouch assembly substantially folded.

FIGS. 7 and 11

The specific steps taken to assemble the advertising pouch will now be described. End panel S and second business reply card panel R are folded along hinge 140 so that end panel S lies flat on intermediate panel P and panel R lies flat on panel Q. Pressure is applied to panels R and S thus forming two business reply cards W and a hidden prize game package X. The business reply cards W and game package X are folded along hinge line 114 so that they lie flat on cover panel U and order organizing panel V. Referring to FIG. 11, the advertising panel T is then folded inwardly to lie flat on business reply cards W, surprise package X and cover panel U. Pressure is applied to the advertising panel at the corners adjacent the upper periphery thus securing it to intermediate panel P. This feature prevents the advertising panel T and business reply cards W from unfolding during the process of inserting literature into the envelope pouch. The adhesive strip is moistened and the closure flap N is subsequently folded along hinge line 106 so that it lies flat on advertising panel T. Pressure is applied to closure flap N thus securing it to the advertising panel T. The advertising pouch assembly K is now ready to be distributed through the mail or other appropriate means to the consumer.

OPENING OF THE ADVERTISING POUCH

FIG. 10

The manner in which the advertising pouch K is opened will be hereinafter described. Upon receipt of the advertising pouch assembly by the consumer, the consumer will remove closure flap N from advertising panel T either by hand or suitable letter opening devices. Inducements or directions on the outerface of the advertising panel T will prompt the consumer to detach the advertising panel T from intermediate panel P. Referring to FIG. 7, upon unfolding the advertising panel T, the business reply cards W and order organizer panel V, the consumer is greeted with a personalized letter from the seller formed on the inner face of cover panel U. The inner face of the advertising panel T has formed thereon the product line of the seller or other messages which the seller wishes to convey to the consumer. Additional advertising literature for the consumer's review is located in the pocket formed by cover panel U and envelope backing panel O.

The game package X provides an incentive to the consumer to read thoroughly the advertising literature rather than summarily dispense with the advertising pouch assembly K. Tab 186 is provided on tear strip 180 to enable the consumer to readily detach the tear strip 180. Upon removal, the prize printed on the inner face of intermediate panel P won by the consumer is revealed.

To place an order, the customer need merely detach one of the business reply cards from the advertising pouch assembly K. In the event that the customer wants to place a reorder he can readily detach the second business reply card and forward it to the seller. The order organizer panel V allows the customer to keep track of the orders he places.

While this invention has been described in connection with different embodiments thereof, it will be understood that it is capable of further modifications, and this application is intended to cover any variation, uses, or adaptations of the invention following, in general, the principals of the inventions and including such departures from the present disclosure as come within known or customary practice in the art to which the invention pertains, and as may be applied to the essential features hereinbefore set forth, and fall within the scope of the invention or the limits of the appended claims.

What is claimed is:

1. An advertising pouch assembly, comprising:

(a) a first web sheet including at least first, second and third spaced parallel hinge lines defining a closure flap, a backing panel, a first business reply card panel and a second business reply card panel, (b) a second web sheet including a cover panel, (c) one of said first and second web sheets having an intermediate hinge line defining an advertising panel, (d) said closure flap including top, bottom, left and right edges, (e) said backing, first business reply card, second business reply card, cover and advertising panels each including top, bottom, left and right edges, (f) said top edge of said backing panel being hingedly connected to said bottom edge of said closure flap, (g) means for securing said left and right edges of said cover panel to said left and right edges respectively of said backing panel, (h) means for securing said bottom edge of said cover panel adjacent said bottom edge of said backing panel for forming a pouch, said pouch having an opening adjacent said bottom edge of said closure flap for accommodating advertising material or the like, (i) means for securing said first business replay card panel to said second business reply card panel for forming at least one double thickness business reply card, (j) said at least one double thickness business reply card, aid backing panel and said cover panel each having printed indicia formed thereon, and (k) means for securing said closure flap to said advertising panel for forming the advertising pouch assembly.

2. An advertising pouch assembly as in claim 1, wherein:

(a) said personalized indicia formed on said cover panel extends parallel to said left and right edges of said cover panel, and, (b) said personalized indicia formed on said at least one double thickness business reply card and said backing panel extend perpendicular to said left and right edges of said at least one double thickness business reply card and said backing panel respectively.

3. An advertising pouch assembly as in claim 1, wherein:

(a) said first web sheet having an advertising panel, (b) said left and right edges of said advertising panel are substantially equal in length, (c) said left and right edges of said backing panel are substantially equal in length, (d) the length of said right edge of said backing panel is greater than the length of the right edge of said advertising panel, and (e) the distance between said top edge of said cover panel and said bottom edge of said backing panel is greater than the length of said right edge of said advertising panel thereby forming a portion of said cover panel readily visible when said advertising panel is folded flat onto said cover panel.

4. An advertising pouch assembly, comprising:

(a) first web sheet including at least first, second and third spaced parallel hinge lines defining a closure flap, a backing panel, a first business reply card panel and a second business reply card panel, (b) a second web sheet including a cover panel, (c) one of said first and second web sheets having an intermediate hinge line defining an advertising panel, (d) said closure flap including top, bottom, left and right edges, (e) said backing, first business replay card, second business reply card, covering and advertising panels each including top, bottom, left and right edges, (f) said top edge of said backing panel being hingedly connected to said bottom of said closure flap, (g) means for securing said left edge of said cover panel to said left edge of said backing panel, (h) means for securing said right edge of said cover panel to said right edge of said backing panel, (i) means for securing said bottom edge of said cover panel adjacent said bottom edge of said backing panel for forming a pouch, said pouch having an opening adjacent said bottom edge of said closure flap for accommodating advertising material or the like, (j) said means for securing said left edge of said cover panel to left edge of said backing panel being an adhesive strip formed on only a portion of one of said left edge of said cover panel and said left edge of backing panel whereby a portion of said left edge of said cover panel adjacent said top edge of said cover panel is free from said backing panel, (k) said means for securing said right edge of said cover panel to said right edge of said backing panel being an adhesive strip formed on only a portion of one of said right edge of said cover panel and said right edge of said backing panel whereby a portion of said right edge of said cover panel adjacent said top edge of said cover panel is free from said backing panel, (l) means for securing said first business reply card panel to said second business reply card panel for forming at least one double thickness business reply card, and (m) means for securing said closure flap to said advertising panel for forming the advertising pouch assembly.

5. An advertising pouch assembly as in claim 4, wherein :

(a) said first web having an advertising panel, (b) a remoist adhesive strip is formed on said closure flap for simultaneously sealing said pouch and said advertising pouch assembly.

6. An advertising pouch assembly, comprising:

(a) a first web sheet including at least first, second and third spaced parallel hinge lines defining a closure flap, a backing panel, a first business reply card panel, (b) a second web sheet including a cover panel, (c) one of said first and second web sheets having an intermediate hinge line defining an advertising panel, (d) said closure flap including top, bottom, left and right edges, (e) said backing, first business reply card, second business reply card, cover and advertising panels each including top, bottom, left and right edges, (f) said top edge of said backing panel being hingedly connected to said bottom edge of said closure flap, (g) means for securing said left and right edges of said cover panel to said left and right edges respectively of said backing, (h) means for securing said bottom edge of said cover panel adjacent said bottom edge of said backing panel for forming a pouch, said pouch having an opening adjacent said bottom edge of said closure flap for accommodating advertising material or the like, (i) said cover panel having an outer surface with printed indicia form thereon, (j) means for securing said first business reply card panel to said second business reply card panel for forming at least one double thickness business reply card, (k) said at least one double thickness business reply card, said backing panel and said cover panel each having printed indicia formed thereon, and (l) means for securing said closure flap to said advertising panel for forming the advertising pouch assembly.

7. An advertising pouch assembly as in claim 6, wherein:

(a) said top edge of said cover panel is positioned intermediate said top and bottom edges of said backing panel.

8. An advertising pouch assembly as in claim 7, wherein:

(a) said bottom edge of said cover panel is secured to said backing panel offset from said bottom edge of said backing panel.

9. An advertising pouch assembly as in claim 6, wherein:

(a) said second web includes an advertising panel, (b) said bottom edge of said advertising panel is hingedly connected to said top edge of said cover panel, and (c) said top edge of said advertising panel extends beyond said top edge of said closure flap when said second web is lying in a unfolded position.

10. An advertising pouch assembly as in claim 9, wherein:

(a) said first web includes an intermediate panel, (b) a top edge of said intermediate panel is hingedly connected to a bottom edge of said backing panel, a bottom edge of said intermediate panel is secured to a top edge of said first business reply card panel, (c) said first web includes an end panel, (d) a top edge of said end panel is secured to a bottom edge of said second business replay card panel, and (e) means for securing said end panel to said intermediate panel.

11. An advertising pouch assembly as in claim 10, wherein:

(a) one of said advertising panel and said intermediate panel having means for securing said advertising panel to said intermediate panel.

12. An advertising pouch assembly as in claim 10, wherein:

(a) said second web includes an order record panel for organizing a recipient's orders.

13. An advertising pouch assembly as in claim 10, wherein:

(a) a tear strip is formed on said end panel.

14. An advertising pouch assembly as in claim 13, wherein:

(a) means for detachably securing said bottom edge of said intermediate panel to said top edge of said first business reply card panel, (b) means for detachably securing said bottom edge of said second business reply card panel to said top edge of said end panel, (c) said first business reply card panel includes a weakness line formed therein and extending parallel to said left and right edges of said first business reply card panel for forming a plurality of first business reply card sections, and (d) said second business reply card panel includes at least one weakness line formed therein and extending parallel to said left and right edges of said second business reply card panel forming a plurality of second business reply card sections, wherein a plurality of double thickness business reply cards are formed when said first business reply card panel is secured to said second business reply card panel.

15. An advertising pouch assembly, comprising:

(a) a pouch having an opening formed therein, (b) said pouch including cover and backing panels, (c) said backing and cover panels each having top, bottom, left and right edges, (d) a closure flap hingedly connected to said top edge of said backing panel, (e) said top edge of said cover panel being positioned intermediate said top and bottom edges of said backing panel wherein literature can be readily inserting in said pouch by a mechanical device, (f) a plurality of panels hingedly connected to one of said backing and cover panels, (g) said plurality of panels including at least one mailing reply card, and (h) said closure flap including means for simultaneously sealing said pouch and the advertising pouch assembly, when said plurality of panels are folded.

16. An advertising pouch assembly as in claim 15, wherein:

(a) means for securing said plurality of panels to said cover panel of said pouch for preventing said plurality of panels from unfolding while literature is being inserted into said pouch by a mechanical device.

17. An advertising pouch assembly, comprising:

(a) a first web sheet including at least first, second and third spaced parallel hinge lines defining a closure flap, a backing panel, a first business reply card panel and a second business reply card panel, (b) a second web sheet including a cover panel, (c) one of said first and second web sheets having an intermediate hinge line defining an advertising panel, (d) said closure flap including top, bottom, left and right edges, (e) said backing, first business replay card, second business reply card, cover and advertising panels each including top, bottom, left and right edges, (f) said top edge of said backing panel being hingedly connected to said bottom edge of said closure flap, (g) means for securing said left and right edges of said cover panel to said left and right edges respectively of said backing panel, (h) mean for securing said bottom edge of said cover panel adjacent said bottom edge of said backing panel for forming a pouch, said pouch having an opening adjacent said bottom edge of said closure flap for accommodating advertising material or the like, (i) means for securing said first business reply card panel to said second business reply card panel for forming at least one double thickness business reply card, (j) said closure flap, backing panel, cover panel and advertising panel each having a width substantially greater than a width of said double thickness business reply card, and (l) means for securing said closure flap to said advertising panel for forming the advertising pouch assembly.

18. An advertising pouch assembly as in claim 11 wherein:

(a) said first web having an advertising panel, (b) said top edge of said advertising panel is hingedly connected to said bottom edge of said backing panel, (c) means for detachably securing said top edge of said first business reply card panel to said bottom edge of said advertising panel, (d) said first business reply card panel having at least one weakness line parallel to said left and right edges of said first business reply card panel forming a plurality of first sections of a business reply card, and, (e) said second business reply card panel having at least one weakness line parallel to said left and right edges of said second business reply card panel for forming a plurality of sections of business reply card.

* * * * *